US009505573B2

(12) United States Patent
Yamagishi et al.

(10) Patent No.: US 9,505,573 B2
(45) Date of Patent: Nov. 29, 2016

(54) SHEET CONVEYING DEVICE, IMAGE FORMING APPARATUS

(71) Applicant: KYOCERA Document Solutions Inc., Osaka-shi, Osaka (JP)

(72) Inventors: Yuki Yamagishi, Osaka (JP); Okito Ogasahara, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/671,671

(22) Filed: Mar. 27, 2015

(65) Prior Publication Data

US 2015/0274468 A1 Oct. 1, 2015

(30) Foreign Application Priority Data

Mar. 31, 2014 (JP) ..... 2014-071941

(51) Int. Cl.
*B65H 5/22* (2006.01)
*B65H 7/08* (2006.01)
*B65H 5/06* (2006.01)

(52) U.S. Cl.
CPC ..... *B65H 7/08* (2013.01); *B65H 5/062* (2013.01); *B65H 2403/11* (2013.01); *B65H 2513/10* (2013.01); *B65H 2513/102* (2013.01); *B65H 2513/106* (2013.01); *B65H 2553/51* (2013.01)

(58) Field of Classification Search
CPC ..... B65H 2513/10; B65H 2403/11; B65H 2513/106
See application file for complete search history.

(56) References Cited

U.S. PATENT DOCUMENTS

2009/0212481 A1* 8/2009 Takayama ..... B65H 3/0684 271/10.11
2011/0064500 A1* 3/2011 Takahashi ..... B65H 5/34 399/396
2016/0089872 A1* 3/2016 Jang ..... B41F 3/58 101/492

FOREIGN PATENT DOCUMENTS

JP 2013099056 A 5/2013

* cited by examiner

*Primary Examiner* — Howard Sanders
(74) *Attorney, Agent, or Firm* — Alleman Hall McCoy Russell & Tuttle LLP

(57) ABSTRACT

In sheet conveying device, first pair of rollers, driven by first driving motor, conveys sheet on conveyance path that passes image forming portion that forms image on the sheet. Second pair of rollers, driven by second driving motor, conveys the sheet on the conveyance path together with the first pair of rollers. Speed difference calculating portion calculates speed difference between speed related to sheet conveyance speed of the first pair of rollers and speed related to sheet conveyance speed of the second pair of rollers. The motor control portion determines target speeds respectively for the first driving motor and the second driving motor based on the speed difference calculated by the speed difference calculating portion, and performs control during non-image formation period so that driving speeds of the first driving motor and the second driving motor respectively become the target speeds.

5 Claims, 4 Drawing Sheets

T1

| SPEED DIFFERENCE ΔV | CORRECTION AMOUNT ΔD FOR DUTY CYCLE OF FIRST DRIVING MOTOR ΔD | CORRECTION AMOUNT ΔG FOR DUTY CYCLE OF SECOND DRIVING MOTOR ΔG |
|---|---|---|
| ΔV1 | ΔD1 | ΔG1 |
| ΔV2 | ΔD2 | ΔG2 |
| ⋮ | ⋮ | ⋮ |
| ΔV(k−1) | ΔD(k−1) | ΔG(k−1) |
| ΔVk | ΔDk | ΔGk |

SHEET CONVEYING DEVICE, IMAGE FORMING APPARATUS

INCORPORATION BY REFERENCE

This application is based upon and claims the benefit of priority from the corresponding Japanese Patent Application No. 2014-071941 filed on Mar. 31, 2014, the entire contents of which are incorporated herein by reference.

BACKGROUND

The present disclosure relates to a sheet conveying device for conveying a sheet and to an image forming apparatus including the sheet conveying device.

Conventionally, an image forming apparatus including an image forming portion, such as a copier, a printer, a facsimile, or a multifunction peripheral which includes the functions of these, is provided with a plurality of pairs of rollers for conveying a sheet on which an image is to be made. The pairs of rollers are driven by the driving motors. In some image forming apparatuses, a certain pair of rollers among the plurality of pairs of rollers requires a dedicated driving control, and is provided with a driving motor that is exclusively used for driving the certain pair of rollers.

Meanwhile, there may be a case where a speed difference above a certain level may occur between the certain pair of rollers and a pair of rollers that is disposed in the upstream or downstream of the certain pair of rollers in the sheet conveyance direction and conveys the sheet on the conveyance path together with the certain pair of rollers. In that case, these pairs of rollers may pull the sheet toward each other, or the sheet may excessively slack. With such a movement, streaks or creases may be generated while the sheet is conveyed. To avoid this problem, the driving motors may be controlled in such a way as to reduce the speed difference between the pairs of rollers.

SUMMARY

A sheet conveying device according to an aspect of the present disclosure includes a first pair of rollers, a first driving motor, a first speed detecting portion, a second pair of rollers, a second driving motor, a second speed detecting portion, a speed difference calculating portion, and a motor control portion. The first pair of rollers conveys a sheet on a conveyance path that passes an image forming portion that forms an image on the sheet. The first driving motor rotationally drives at least one roller of the first pair of rollers. The first speed detecting portion detects a speed related to a sheet conveyance speed of the first pair of rollers. The second pair of rollers conveys the sheet on the conveyance path together with the first pair of rollers. The second driving motor rotationally drives at least one roller of the second pair of rollers. The second speed detecting portion detects a speed related to a sheet conveyance speed of the second pair of rollers. The speed difference calculating portion calculates a speed difference between a first detected speed detected by the first speed detecting portion and a second detected speed detected by the second speed detecting portion. The motor control portion determines target speeds respectively for the first driving motor and the second driving motor based on the speed difference calculated by the speed difference calculating portion, and performs a control during a non-image formation period so that driving speeds of the first driving motor and the second driving motor respectively become the target speeds for the first driving motor and the second driving motor.

An image forming apparatus according to another aspect of the present disclosure includes the sheet conveying device.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the drawings. It should be noted that the following description is an example of a specific embodiment of the present disclosure and should not limit the technical scope of the present disclosure.

Figure 1:
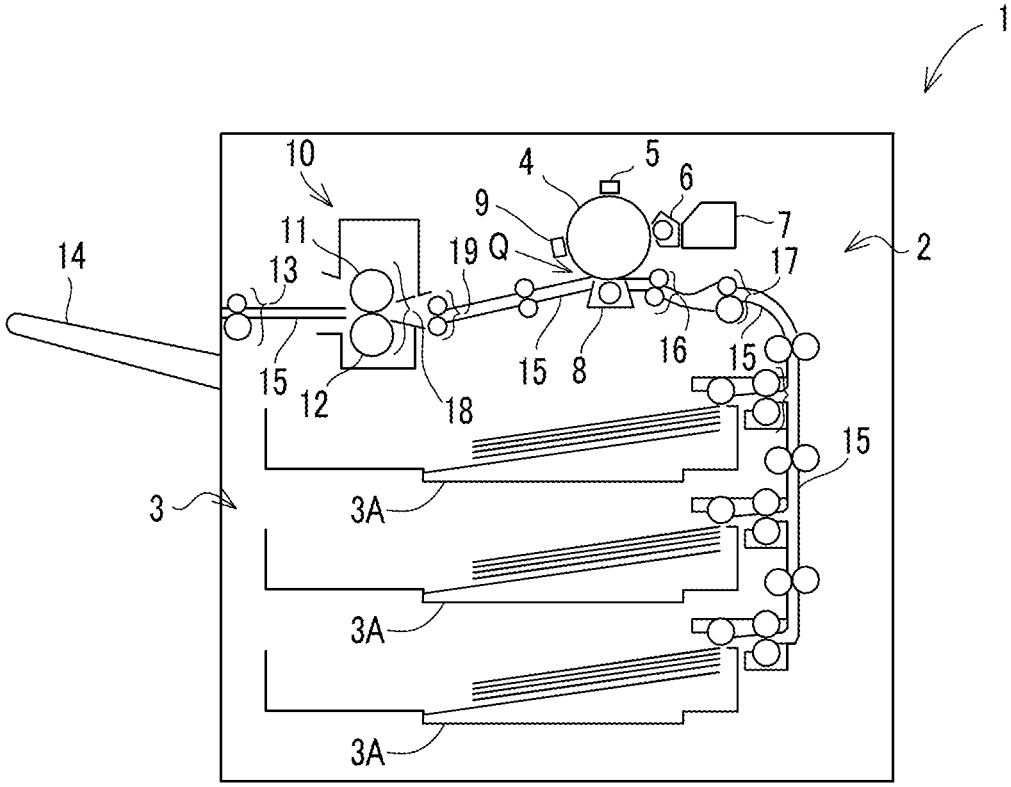
FIG. 1 is a diagram showing the configuration of an image forming apparatus according to an embodiment of the present disclosure.

First, the configuration of an image forming apparatus 1 according to an embodiment of the present disclosure is described. The image forming apparatus 1 is a printer, and as shown in FIG. 1, includes an image forming portion 2 and a sheet feed portion 3. Other examples of the image forming apparatus of the present disclosure include image forming apparatuses such as a facsimile, a copier, and a multifunction peripheral.

As shown in FIG. 1, the image forming portion 2 executes an image forming process (print process) based on a print job which has been input from an external information processing apparatus such as a personal computer. Specifically, the image forming portion 2 is an electrophotographic image forming portion including a photoconductor drum 4 (an image carrier), a charging portion 5, a developing portion 6, a toner container 7, a transfer roller 8, an electricity removing portion 9, a fixing portion 10 and the like. It is noted that although, in the present embodiment, the electrophotographic image forming portion 2 is described as an example, the image forming method of the image forming portion 2 is not limited to the electrophotography, but may be another method such as the inkjet recording method.

In the image forming portion 2, the image forming process of forming an image on a sheet P supplied from the sheet feed portion 3 is performed in the following procedure.

First, when a print job including a print instruction is input from an external apparatus, the charging portion 5 charges the surface of the photoconductor drum 4 uniformly into a certain potential. Next, a laser scanner unit (not shown) irradiates the surface of the photoconductor drum 4 with light based on the image data included in the print job. With this operation, an electrostatic latent image is formed on the surface of the photoconductor drum 4.

The electrostatic latent image on the photoconductor drum 4 is then developed (visualized) as a toner image by the developing portion 6. It is noted that the toner (developer) is supplied to the developing portion 6 from the toner container 7. Subsequently, the toner image formed on the photoconductor drum 4 is transferred to the sheet P by the transfer roller 8. The position at which the toner image is transferred to the sheet P is referred to as a transfer position Q.

A pair of rollers 16 is provided at a predetermined position in the upstream of the transfer position Q. The pair of rollers 16 temporarily stops the conveyance of the sheet P that has been conveyed from the upstream in the sheet conveyance direction, and conveys the sheet P toward the transfer position Q such that the sheet P reaches the transfer position Q at the timing when the toner image formed on the surface of the photoconductor drum 4 reaches the transfer position Q. The potential that has remained on the photoconductor drum 4 after the transfer is removed by the electricity removing portion 9. Subsequently, the sheet P is passed through the fixing portion 10, in which the toner image transferred thereto is heated in such a way as to be fused and fixed thereto, and the sheet P is discharged.

The sheet feed portion 3 includes a plurality of attachable/detachable sheet feed cassettes 3A, and supplies sheets P that are stored in the sheet feed cassettes 3A to the image forming portion 2.

The fixing portion 10 heats the sheet P such that the toner image transferred to the sheet P is fused and fixed to the sheet P. The fixing portion 10 includes a fixing roller 11 and a pressure roller 12. The sheet P to which the toner image was fixed by the fixing portion 10 is discharged onto a discharge tray 14 by a pair of discharge rollers 13.

In the image forming apparatus 1, a sheet conveyance path 15 is formed extending from the sheet feed portion 3 to the discharge tray 14 via the image forming portion 2. In the sheet conveyance path 15, a plurality of pairs of rollers are disposed, including the pair of rollers 16 and a pair of rollers 18 which is composed of the fixing roller 11 and the pressure roller 12. Among these pairs of rollers, for example, the pair of rollers 16 requires a dedicated driving control since, as described above, the pair of rollers 16 is required to temporarily stop the conveyance of a sheet and convey the sheet toward the transfer position Q such that the sheet reaches the transfer position Q at the timing when the toner image formed on the surface of the photoconductor drum 4 reaches the transfer position Q, and for that, a special rotation control is required. As a result, a dedicated driving motor M1 (see FIG. 2) is provided for the pair of rollers 16 exclusively, and the pair of rollers 16 is driven by the driving motor M1.

As a result, a pair of rollers 17, which is disposed in the upstream of the pair of rollers 16 in conveyance direction of the sheet P and conveys, together with the pair of rollers 16, the sheet P on the sheet conveyance path 15, is driven by a driving motor M2 (see FIG. 2) that is different from the motor M1 for driving the pair of rollers 16. In the following, the driving control of the pair of rollers 16 and the pair of rollers 17 is described. The pair of rollers 16 and the pair of rollers 17 are respectively examples of the first pair of rollers and the second pair of rollers.

Figure 2:
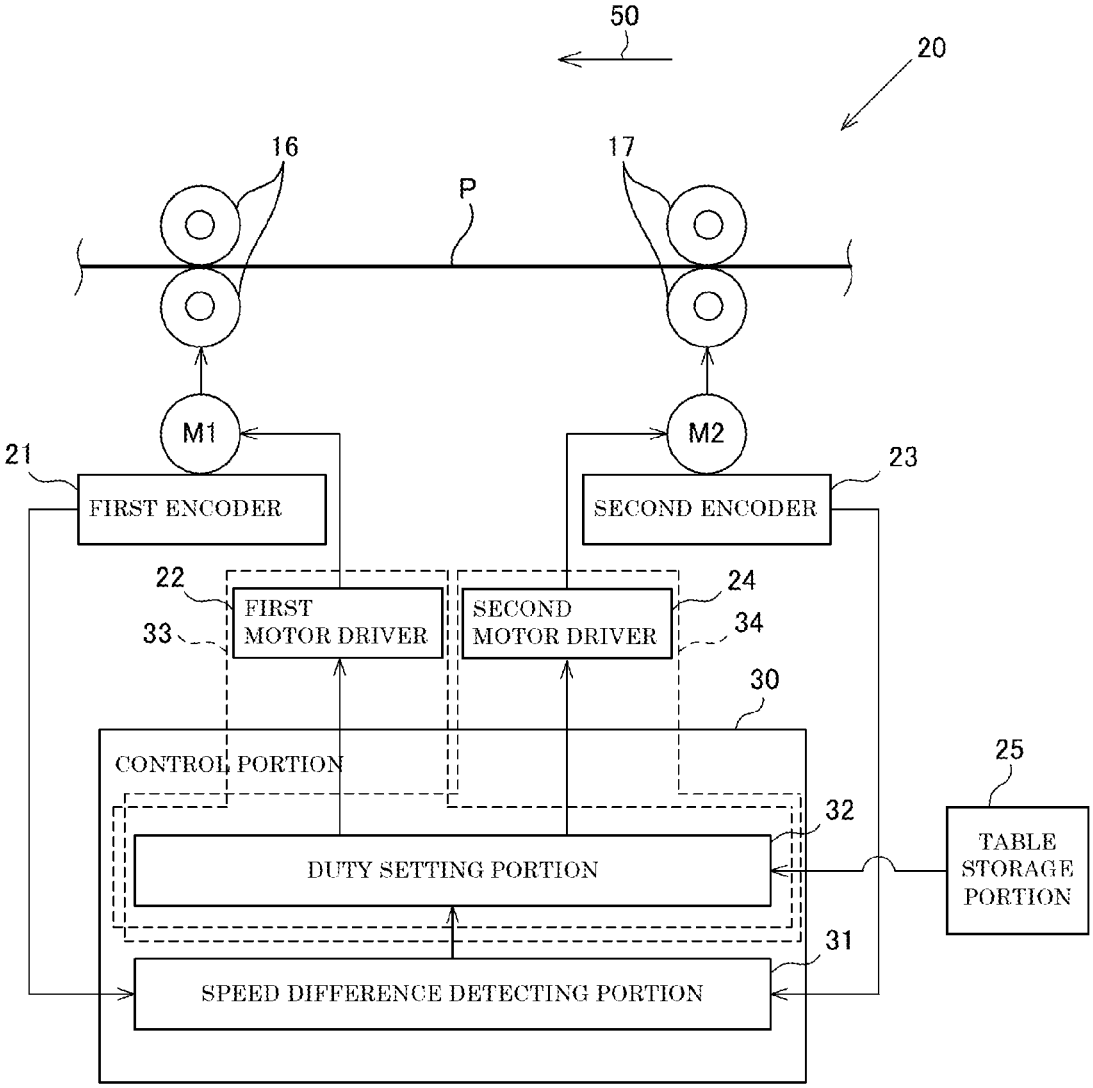
FIG. 2 is a block diagram showing the configuration of the image forming apparatus according to an embodiment of the present disclosure.

As shown in FIG. 2, the image forming apparatus 1 includes a sheet conveying device 20. The sheet conveying device 20 in the present embodiment includes the pair of rollers 16, the pair of rollers 17, a first driving motor M1, a first encoder 21, a first motor driver 22, a second driving motor M2, a second encoder 23, a second motor driver 24, a table storage portion 25, and a control portion 30.

The first driving motor M1 and the second driving motor M2 are, for example, DC brushless motors. The first driving motor M1 rotationally drives the pair of rollers 16 by rotating one roller of the pair of rollers 16, and the second driving motor M2 drives the pair of rollers 17 by rotating one roller of the pair of rollers 17. The first motor driver 22 is, for example, a driving circuit that controls the rotation speed of the first driving motor M1 by the PWM (Pulse Width Modulation) method. The second motor driver 24 is, for example, a driving circuit that controls the rotation speed of the second driving motor M2 by the PWM (Pulse Width Modulation) method.

Figures 3, 4:
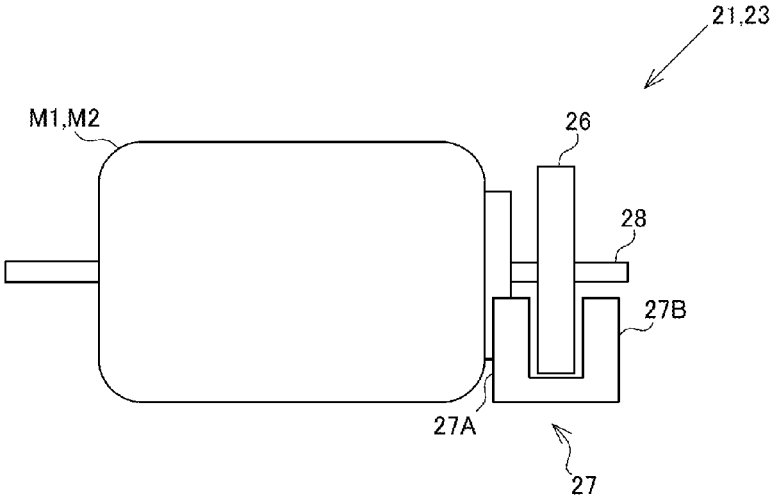
FIG. 3 is a diagram showing the configuration of a first encoder and a second encoder.
FIG. 4 is a diagram showing a control table T1 that defines driving conditions for driving a first pair of rollers and a second pair of rollers, for each possible value of a speed difference ΔV which is the difference between a rotation speed V1 of the first pair of rollers and a rotation speed V2 of the second pair of rollers.

The first encoder 21 and the second encoder 23 have the same configuration, and are, for example, rotary encoders. As shown in FIG. 3, the first encoder 21 and the second encoder 23 each include a pulse plate 26 and a photointerrupter 27, wherein the pulse plate 26 is a circular plate. A number of slits (not shown) are formed in the pulse plate 26 along the circumference thereof. The pulse plates 26 are respectively fixed to output shafts 28 of the first driving motor M1 and the second driving motor M2. The photointerrupter 27 includes a light-emitting portion 27A and a light-receiving portion 27B that are disposed to face each other with a space therebetween.

The pulse plate 26 is rotated around the output shaft 28 in the state where a part of the pulse plate 26 is inserted in the space between the light-emitting portion 27A and the light-receiving portion 27B. The signal output from the light-receiving portion 27B varies between two levels for the two cases: a case where the light emitted from the light-emitting portion 27A passes through a slit of the pulse plate 26 and is received by the light-receiving portion 27B; and a case where the light emitted from the light-emitting portion 27A is interrupted by a portion of the pulse plate 26 other than the slits. As the pulse plate 26 is rotated, a pulse signal is output from the light-receiving portion 27B to the control portion 30. The control portion 30 calculates the rotation speeds of the respective output shafts 28 of the first driving motor M1 and the second driving motor M2, based on the number of pulses included in the pulse signal per unit time (namely, the frequency of the pulse signal).

As shown in FIG. 2, in the present embodiment, the table storage portion 25 is provided in a storage portion (not shown) such as a hard disk drive (HDD). The table storage portion 25 corresponds to the storage portion of the present disclosure. A control table T1 (see FIG. 4) is stored in the table storage portion 25 in advance.

The control table T1 defines the driving conditions of the pair of rollers 16 and the pair of rollers 17 for each possible value of speed difference $\Delta V$ which is the difference between a rotation speed V1 of the pair of rollers 16 and a rotation speed V2 of the pair of rollers 17. As shown in FIG. 4, the control table T1 of the present embodiment defines, as the driving conditions of the pair of rollers 16 and the pair of rollers 17, correction amounts $\Delta D$ and $\Delta G$ for duty cycles D and G of the PWM signals that are output to the first driving motor M1 and the second driving motor M2, respectively. That is, the control table T1 defines the correspondence between the speed difference ΔV and the correction amounts ΔD and ΔG for the PWM signals that are respectively output to the first driving motor M1 and the second driving motor M2.

For example, in the control table T1 shown in FIG. 4, ΔV1 corresponds to ΔD1 and ΔG1, wherein ΔV1 is a speed difference ΔV between the rotation speed V1 of the pair of rollers 16 and the rotation speed V2 of the pair of rollers 17, ΔD1 is a correction amount ΔD for the duty cycle D of the PWM signal that is output to the first driving motor M1, and ΔG1 is a correction amount ΔG for the duty cycle G of the PWM signal that is output to the second driving motor M2. That is, the control table T1 defines that, when the speed difference ΔV between the rotation speed V1 of the pair of rollers 16 and the rotation speed V2 of the pair of rollers 17 is ΔV1, the correction amount ΔD for the duty cycle D of the PWM signal that is output to the first driving motor M1 should be ΔD1, and the orrection amount ΔG of the duty cycle G of the PWM signal that is output to the second driving motor M2 should be ΔG1.

In addition, in the example of the control table T1, ΔV2 corresponds to ΔD2 and ΔG2, wherein ΔV2 is a speed difference ΔV between the rotation speed V1 of the pair of rollers 16 and the rotation speed V2 of the pair of rollers 17, ΔD2 is a correction amount ΔD for the duty cycle D of the PWM signal that is output to the first driving motor M1, and ΔG2 is a correction amount ΔG for the duty cycle G of the PWM signal that is output to the second driving motor M2. That is, the control table T1 defines that, when the speed difference ΔV between the rotation speed V1 of the pair of rollers 16 and the rotation speed V2 of the pair of rollers 17 is ΔV2, the correction amount ΔD for the duty cycle D of the PWM signal that is output to the first driving motor M1 should be ΔD2, and the orrection amount ΔG of the duty cycle G of the PWM signal that is output to the second driving motor M2 should be ΔG2.

In this way, in the table storage portion 25, correction amounts ΔD and ΔG are set for each possible value of the speed difference ΔV, wherein correction amounts ΔD and ΔG are respectively correction amounts for duty cycles D and G that respectively correspond to target speeds of the first driving motor M1 and the second driving motor M2. The control table T1 is used when the control portion 30 changes the duty cycles D and G of the PWM signals in correspondence with the speed difference ΔV.

The control portion 30 includes a CPU, a ROM, and a RAM. The CPU is a processor for executing various types of arithmetic processes. The ROM is a nonvolatile storage portion in which various types of information such as control programs for causing the CPU to execute various types of processes are stored in advance. The RAM is a volatile storage portion that is used as a primary storage memory (working area) for the various types of processes executed by the CPU. The control portion 30 controls the operation of the image forming apparatus 1 as the CPU executes the programs stored in the ROM. It is noted that the image forming portion 2, the sheet feed portion 3, the table storage portion 25, the first encoder 21, and the second encoder 23 are electrically connected to the control portion 30.

The control portion 30 realizes a speed difference detecting portion 31 and a duty cycle setting portion 32 by executing the programs by using the CPU.

The speed difference detecting portion 31 detects, as the rotation speed V1 of the pair of rollers 16, the rotation speed of the output shaft 28 of the first driving motor M1 based on the output from the first encoder 21. In addition, the speed difference detecting portion 31 detects, as the rotation speed V2 of the pair of rollers 17, the rotation speed of the output shaft 28 of the second driving motor M2 based on the output from the second encoder 23. The speed difference detecting portion 31 and the first encoder 21 are an example of the first speed detecting portion configured to detect a speed related to a speed at which the sheet P is conveyed by the pair of rollers 16. The speed difference detecting portion 31 and the second encoder 23 are an example of the second speed detecting portion configured to detect a speed related to a speed at which the sheet P is conveyed by the pair of rollers 17. The speed difference detecting portion 31 further detects the speed difference ΔV between the rotation speed V1 detected with use of the first encoder 21 and the rotation speed V2 detected with use of the second encoder 23.

The duty cycle setting portion 32, when the speed difference detecting portion 31 detects the speed difference ΔV, refers to the control table T1 stored in the table storage portion 25, and based on the control table T1, sets the correction amounts ΔD and ΔG for the PWM signals that are respectively output to the first driving motor M1 and the second driving motor M2. For example, when the speed difference ΔV between the rotation speed V1 and the rotation speed V2 is ΔV1, the duty cycle setting portion 32 sets the correction amount ΔD for the duty cycle of the PWM signal that is output to the first driving motor M1, to ΔD1, and sets the correction amount ΔG for the duty cycle of the PWM signal that is output to the second driving motor M2, to ΔG1. The duty cycle setting portion 32 then outputs command signals specifying the duty cycles D and G that have been respectively corrected by the correction amounts ΔD1 and ΔG1, to the first motor driver 22 and the second motor driver 24, respectively. It is noted that in the present embodiment, the correction amount ΔD is set to "0" because, when the duty cycle D of the PWM signal output to the first driving motor M1 is changed, the relationship with the rotation speed of the photoconductor drum 4 and the like changes.

Upon receiving the command signals from the duty cycle setting portion 32, the first motor driver 22 and the second motor driver 24 generate PWM signals with the duty cycles set by the duty cycle setting portion 32, and output the generated PWM signals respectively to the first driving motor M1 and the second driving motor M2. Here, when the correction amount ΔD for the duty cycle D of the PWM signal output to the first driving motor M1 has been set to ΔD1 by the duty cycle setting portion 32, and the correction amount ΔG for the duty cycle G of the PWM signal output to the second driving motor M2 has been set to ΔG1 by the duty cycle setting portion 32, the first driving motor M1 is driven by the PWM signal with the duty cycle D corrected by the correction amount ΔD1, and the second driving motor M2 is driven by the PWM signal with the duty cycle G corrected by the correction amount ΔG1.

A motor control portion 33, which is composed of the first motor driver 22 and the duty cycle setting portion 32, performs the feedback control of the rotation speed of the first driving motor M1 and further the rotation speed of the pair of rollers 16. Furthermore, a motor control portion 34, which is composed of the second motor driver 24 and the duty cycle setting portion 32, performs the feedback control of the rotation speed of the second driving motor M2 and further the rotation speed of the pair of rollers 17. The motor control portions 33 and 34 correspond to the motor control portion of the present disclosure.

Meanwhile, when the above-mentioned feedback control is always performed, including during the image formation period, the rotation speeds of the pair of rollers 16 and the pair of rollers 17 change during the image formation period due to the feedback control. In that case, the speed at which the sheet P is conveyed by the pair of rollers 16 and the pair of rollers 17 changes during the image formation period. When this happens, the image may stretch or shrink. In that case, the quality of the image formed on the sheet P may be degraded. It is noted that "the image formation period" means a time period during which the sheet P is conveyed not only by the pair of rollers 16 but also by the pair of rollers 17 such that the toner image formed on the surface of the photoconductor drum 4 is transferred to the sheet P.

In view of the above, in the present embodiment, during a non-image formation period, the duty cycle setting portion 32 outputs the command signals specifying the duty cycles D and G corrected by the correction amounts ΔD1 and ΔG1 defined in the control table T1, to the first motor driver 22 and the second motor driver 24, respectively.

Specifically, the duty cycle setting portion 32 outputs the command signals to the first motor driver 22 and the second motor driver 24 during a non-transfer period in which the transfer process of transferring the toner image formed on the surface of the photoconductor drum 4 to the sheet P is not executed. The control portion 30 determines whether or not the current time is in the non-transfer period, based on, for example, the time from a driving start of the pair of rollers 16 (the time when the pair of rollers 16 started conveying the sheet P). That is, the control portion 30 calculates the time when the sheet P is passing through the transfer position Q based on the time from the driving start of the pair of rollers 16, and determines that the current time is in the transfer period when the sheet P is passing through the transfer position Q, and determines that the current time is in the non-transfer period when the sheet P is not present at the transfer position Q. It is noted that, strictly, when the sheet P is present at the transfer position Q and being conveyed by at least the pair of rollers 16, it may be determined that the current time is in the transfer period. With this configuration, a control is made such that the driving speeds of the first driving motor M1 and the second driving motor M2 are maintained at the current driving speeds during the transfer period, and during the non-transfer period, the driving speeds of the first driving motor M1 and the second driving motor M2 are changed to the target speeds (the driving speeds that have been corrected based on the correction values for the duty cycles set by the duty cycle setting portion 32) based on the command signals. With such a control, it is possible to avoid the quality of the image formed on the sheet P from being degraded due to the change in the conveyance speed of the sheet P during the transfer that is caused by the feedback control during the transfer.

Figure 5:
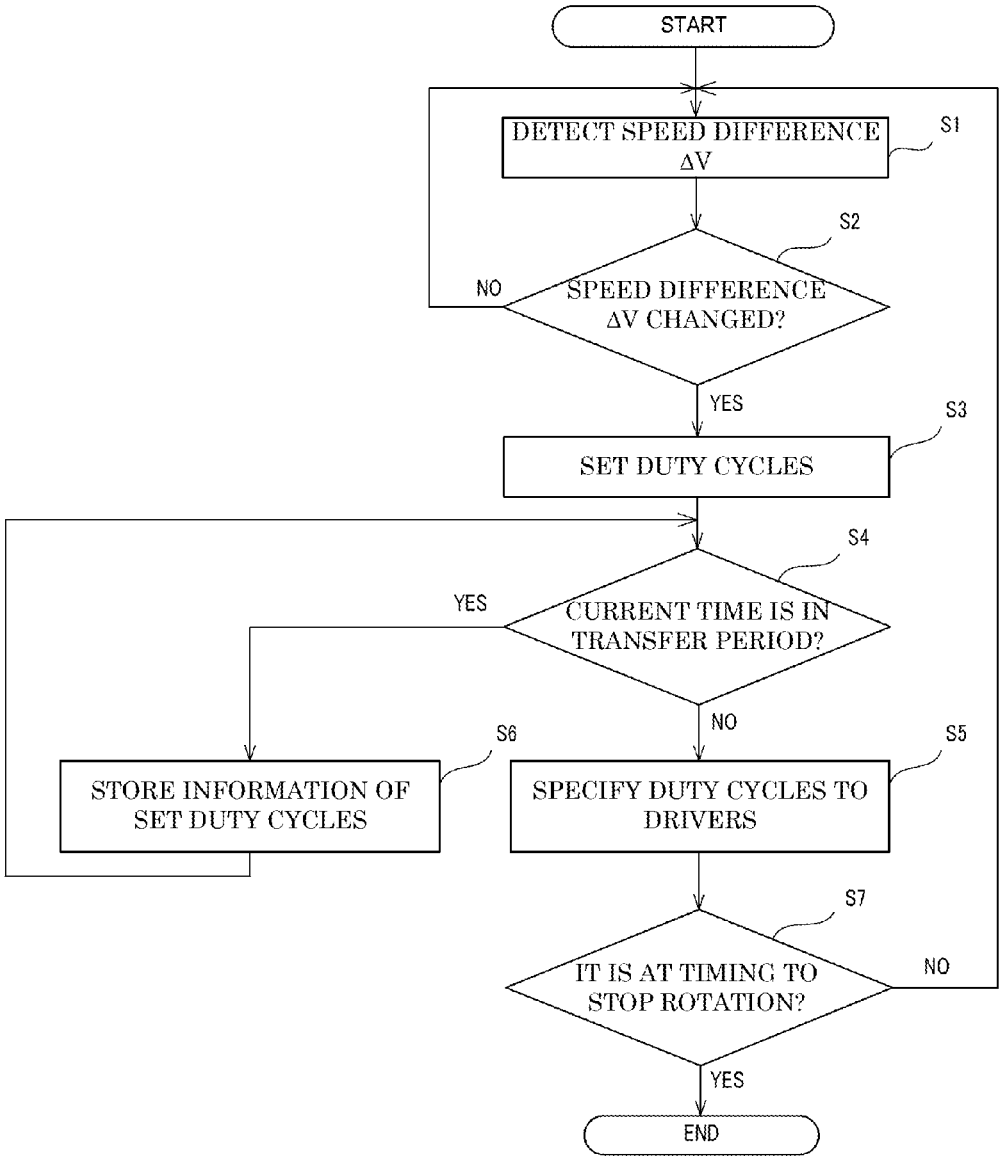
FIG. 5 is a flowchart showing a rotation control of the first and second pairs of rollers performed by a control portion.

Next, the following describes the control of the rotation of the pair of rollers 16 and the pair of rollers 17 by the control portion 30, with reference to FIG. 5. The rotational control is performed when the control portion 30 starts rotating the pair of rollers 16 and the pair of rollers 17 upon receiving a print job. It is noted that in the flowchart of FIG. 5, steps S1, S2, . . . represent numbers of the processing procedures (steps). In addition, it is supposed that, at the start of the rotation, a speed difference ΔV0 between the driving speed V1 of the first driving motor M1 and the driving speed V2 of the second driving motor M2 is set to a reference value that has been set at the manufacture of the image forming apparatus 1. Here, in this example, the reference value is 0.

As shown in FIG. 5, when the control portion 30 starts rotating the pair of rollers 16 and the pair of rollers 17, the speed difference detecting portion 31 starts the process of detecting the speed difference ΔV between the rotation speed V1 detected by the first encoder 21 and the rotation speed V2 detected by the second encoder 23 (step S1). The speed difference detecting portion 31 determines whether or not the speed difference ΔV has changed from the reference value (step S2). When the speed difference detecting portion 31 determines that the speed difference ΔV has not changed from the reference value (NO at step S2), the process returns to step S1.

When the speed difference detecting portion 31 determines that the speed difference ΔV has changed from the reference value (YES at step S2), the duty cycle setting portion 32 reads, from the control table T1 stored in the table storage portion 25, the correction amounts ΔD and ΔG for duty cycles D and G correponding to the speed difference ΔV, and sets duty cycles D and G after the correction (step S3).

The duty cycle setting portion 32 determines whether or not the current time is in the transfer period (image formation period) based on the time from the rotation start of the pair of rollers 16 (step S4). When the duty cycle setting portion 32 determines that the current time is not in the transfer period (NO at step S4), the duty cycle setting portion 32 outputs command signals specifying the duty cycles D and G set in step S3, to the first motor driver 22 and the second motor driver 24, respectively. Upon receiving the command signals, the first motor driver 22 and the second motor driver 24 generate PWM signals that have the duty cycles D and G respectively specified by the command signals, and output the generated PWM signals to the first driving motor M1 and the second driving motor M2, respectively (step S5), and the process proceeds to step S7.

On the other hand, when the duty cycle setting portion 32 determines that the current time is in the transfer period (YES at step S4), the duty cycle setting portion 32 temporarily stores information of the duty cycles D and G that were set in step S3, into the RAM (step S6), and the process returns to step S4. Here, in the process of step S6, if information of the duty cycles D and G that had been set previously is stored in the RAM, the duty cycle setting portion 32 stores the information of the duty cycles D and G that were set in step S3, into the RAM to update the previous information.

After the process of step S5, the control portion 30 determines whether or not it is the timing to stop the rotation of the pair of rollers 16 and the pair of rollers 17 (step S7). The conditions for the control portion 30 to determine the above are that the number of sheets P corresponding to the print job have been conveyed from the sheet feed portion 3 and the output signal of the discharge sensor (not shown) disposed in the downstream of the pair of discharge rollers 13 in the conveyance direction of the sheet P indicates that no sheet P is present at a detection area of a discharge sensor (not shown) for at least a predetermined time period. When the control portion 30 determines that it is not the timing to stop the rotation of the pair of rollers 16 and the pair of rollers 17 (NO at step S7), the process returns to step S1. Upon returning to step S1, the speed difference detecting portion 31 detects the speed difference ΔV in the state where the pair of rollers 16 and the pair of rollers 17 are rotationally driven with the corrected duty cycles D and G, respectively. Subsequently, the process of step S2 and onward are executed based on this speed difference ΔV. On the other hand, when the control portion 30 determines that it is the timing to stop the rotation of the pair of rollers 16 and the pair of rollers 17 (YES at step S7), the series of processes is ended. It is noted that when the feedback control is performed based on only the speed difference ΔV between the rotation speeds of the first driving motor M1 and the second driving motor M2, the rotation speeds of the first driving motor M1 and the second driving motor M2 may be out of an appropriate range of the conveyance speed of sheet P. As a result, for example, after the process of step S5, the control portion 30 determines whether or not the rotation speeds of the first driving motor M1 and the second driving motor M2 are within the appropriate range of the conveyance speed of sheet P. When the control portion 30 determines that the rotation speeds of the first driving motor M1 and the second driving motor M2 are out of the appropriate range of the sheet P conveyance speed, the control portion 30 performs the feedback control of the rotation speeds V1 and V2 so that the rotation speed V1 of the first driving motor M1 and the rotation speed V2 of the second driving motor M2 are within the appropriate range of the conveyance speed of sheet P.

As described above, in the present embodiment, the rotation speed of the second driving motor M2 that drives the pair of rollers 17 is controlled to become a target speed in correspondence with a possible value of the speed difference ΔV between the rotation speed V1 of the pair of rollers 16 and the rotation speed V2 of the pair of rollers 17. In addition, the control is performed during the non-transfer period. This makes it possible to convey the sheet in an appropriate state while avoiding the reduction in quality of the image formed on the sheet that would happen if the rotation speeds of pairs of rollers change because this control is performed during the transfer period.

Furthermore, in the present embodiment, correction amounts ΔD and ΔG for duty cycles D and G of the PWM signals corresponding to the speed difference ΔV are derived from the control table T1. This makes it possible to derive duty cycles D and G after correction without imposing a large load on the processing by the control portion 30.

Furthermore, in the present embodiment, the rotation speed of the output shaft 28 of the first driving motor M1 is detected as the rotation speed of the pair of rollers 16, and the rotation speed of the output shaft 28 of the second driving motor M2 is detected as the rotation speed of the pair of rollers 17. With this configuration, the first encoder 21 and the second encoder 23 can be disposed closer to the control boards (not shown) of the first driving motor M1 and the second driving motor M2, than the configuration where the first encoder 21 and the second encoder 23 are disposed at the pair of rollers 16 and the pair of rollers 17. This makes it possible to shorten the wiring.

Up to now, a preferable embodiment of the present disclosure has been described. However, the present disclosure is not limited to the above-described embodiment, but various modifications are applicable.

In the above-described embodiment, the pair of rollers 16 and the pair of rollers 17 are controlled to convey the sheet. However, the pairs of rollers that are the target of control in the present disclosure are not limited to the pair of rollers 16 and the pair of rollers 17. For example, the pair of rollers 18 which is composed of the fixing roller 11 and the pressure roller 12 also requires a dedicated driving control, and the pair of rollers 18 is driven by a driving motor that is provided exclusively for the pair of rollers 18. As a result, a pair of rollers 19, which is disposed in the upstream of the pair of rollers 18 in the sheet conveyance direction and conveys, together with the pair of rollers 18, the sheet on the sheet conveyance path 15, is driven by a driving motor that is different from the motor that drives the pair of rollers 18. In that case, when the sheet conveyance speeds change during the fixing period, an uneven fixing may occur and the quality of the image formed on the sheet may be degraded.

As a result, the duty cycle setting portion 32 outputs the command signals respectively to the first motor driver 22 and the second motor driver 24 during a non-fixing period in which there is no sheet in the fixing portion 10. With this configuration, a control is made such that, during the fixing period, the driving speeds of the first driving motor and the second driving motor are maintained at the current driving speeds, and during the non-fixing period, the driving speeds of the first driving motor and the second driving motor are changed to the target speeds based on the command signals. With such a control, it is possible to avoid the quality of the image formed on the sheet P from being degraded due to the change in the conveyance speed of the sheet P during the fixing caused by the feedback control performed during the fixing.

When the pair of rollers 18 conveys, together with the pair of rollers 16, the sheet on the sheet conveyance path 15, the pair of rollers 18 and the pair of rollers 16 are driven by different driving motors. As a result, the pair of rollers 16 and the pair of rollers 18 can also be the pairs of rollers that are the target of control according to the present disclosure.

In the present disclosure, the pair of discharge rollers 13 is disposed in the downstream of the pair of rollers 18 in the sheet conveyance direction and conveys the sheet on the sheet conveyance path 15 together with the pair of rollers 18. The pair of discharge rollers 13 is driven by a driving motor that is different from the motor that drives the pair of rollers 18. As a result, the pair of discharge rollers 13 and the pair of rollers 18 can also be the pairs of rollers that are the target of control according to the present disclosure.

In the present embodiment, when a speed difference ΔV is detected, correction amounts ΔD and ΔG for duty cycles D and G of the PWM signals that are to be output to the first driving motor M1 and the second driving motor M2 are read from the control table T1 in correspondence with the speed difference ΔV, and PWM signals with the duty cycles corrected by the correction amounts ΔD and ΔG are output to the first driving motor M1 and the second driving motor M2. However, the duty cycle setting method of the present disclosure is not limited to the method for setting by using the control table T1.

For example, the duty cycle setting portion 32 may calculate the duty cycles for the PWM signals that are to be output to the first driving motor M1 and the second driving motor M2, from a predetermined formula with the speed difference ΔV as a parameter. The predetermined formula may be, for example, such a formula from which is calculated the duty cycle G for the PWM signal output to the second driving motor M2 that is defined in the control table T1 of the above-described embodiment. With the configuration where the duty cycles are calculated from the predetermined formula with the speed difference ΔV as a parameter, the table storage portion 25 does not need to be provided. This makes it possible to reduce the storage capacity of the storage portion included in the image forming apparatus 1 by the size of the table storage portion 25.

In the above-described embodiment, the rotation speed of the output shaft 28 of the first driving motor M1 is detected as the rotation speed of the pair of rollers 16, and the rotation speed of the output shaft 28 of the second driving motor M2 is detected as the rotation speed of the pair of rollers 17. However, the present disclosure includes a configuration where the first encoder 21 and the second encoder 23 are attached to the rotation shafts (not shown) of the pair of rollers 16 and the pair of rollers 17, respectively.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A sheet conveying device comprising:

a first pair of rollers configured to convey a sheet on a conveyance path that passes an image forming portion that forms an image on the sheet;

a first driving motor configured to rotationally drive at least one roller of the first pair of rollers;

a first speed detecting portion configured to detect a speed related to a sheet conveyance speed of the first pair of rollers;

a second pair of rollers configured to convey the sheet on the conveyance path together with the first pair of rollers;

a second driving motor configured to rotationally drive at least one roller of the second pair of rollers;

a second speed detecting portion configured to detect a speed related to a sheet conveyance speed of the second pair of rollers;

a speed difference calculating portion configured to calculate a speed difference between a first detected speed detected by the first speed detecting portion and a second detected speed detected by the second speed detecting portion;

a motor control portion configured to determine target speeds respectively for the first driving motor and the second driving motor based on the speed difference calculated by the speed difference calculating portion, and performs a control during a non-image formation period so that driving speeds of the first driving motor and the second driving motor respectively become the target speeds for the first driving motor and the second driving motor; and a storage portion configured to store, in advance, correspondence between each possible value of the speed difference that may be calculated by the speed difference calculating portion, and correction amounts for duty cycles of PWM signals that are output to the first driving motor and the second driving motor, wherein when the speed difference is calculated by the speed difference calculating portion, the motor control portion reads correction amounts for duty cycles of PWM signals for the first driving motor and the second driving motor that correspond to a value of the speed difference calculated by the speed difference calculating portion, and drives the first driving motor and the second driving motor by PWM signals corrected by the correction amounts read from the storage portion.

2. The sheet conveying device according to claim 1, wherein either the first pair of rollers or the second pair of rollers is a pair of rollers that conveys the sheet toward a predetermined transfer position such that the sheet reaches the transfer position at a timing when a toner image formed on an image carrier provided in the image forming portion reaches the transfer position, and the motor control portion determines the target speeds respectively for the first driving motor and the second driving motor based on the speed difference calculated by the speed difference calculating portion, and performs the control during a non-transfer period so that driving speeds of the first driving motor and the second driving motor respectively become the target speeds for the first driving motor and the second driving motor.

3. The sheet conveying device according to claim 1, wherein either the first pair of rollers or the second pair of rollers is a pair of rollers that fixes a toner image to the sheet, and the motor control portion determines the target speeds respectively for the first driving motor and the second driving motor based on the speed difference calculated by the speed difference calculating portion, and performs the control during a non-fixing period so that driving speeds of the first driving motor and the second driving motor respectively become the target speeds for the first driving motor and the second driving motor.

4. The sheet conveying device according to claim 1, wherein the first speed detecting portion detects a rotation speed of an output shaft of the first driving motor, as the speed related to the sheet conveyance speed of the first pair of rollers, and the second speed detecting portion detects a rotation speed of an output shaft of the second driving motor, as the speed related to the sheet conveyance speed of the second pair of rollers.

5. An image forming apparatus comprising the sheet conveying device according to claim 1.

* * * * *